United States Patent [19]

Suzuki et al.

[11] 4,433,717

[45] Feb. 28, 1984

[54] PROCESS FOR BOW TYPE CONTINUOUS CASTING

[75] Inventors: Yasuo Suzuki; Shuji Nagata, both of Kitakyushu; Takashiro Nonaka; Tadashi Murakami, both of Himeji, all of Japan

[73] Assignee: Nippon Steel Corporation, Tokyo, Japan

[21] Appl. No.: 250,303

[22] Filed: Apr. 2, 1981

[30] Foreign Application Priority Data

Apr. 2, 1980 [JP] Japan ..... 55-43380
Apr. 2, 1980 [JP] Japan ..... 55-43382

[51] Int. Cl.[3] ..... B22D 11/16

[52] U.S. Cl. ..... 164/454; 164/455; 164/477; 164/484

[58] Field of Search ..... 164/442, 448, 484, 454, 164/455, 477

[56] References Cited

U.S. PATENT DOCUMENTS 3,324,931 6/1967 Bungeroth ..... 164/442
3,729,048 4/1973 Gelfenbein ..... 164/484

*Primary Examiner*—Gus T. Hampilos
*Assistant Examiner*—Richard K. Seidel
*Attorney, Agent, or Firm*—Wenderoth, Lind & Ponack

[57] ABSTRACT

The present invention relates to a bow type continuous casting process using a curved mold, wherein molten steel is continuously cast into the curved mold to obtain a curved strand, e.g. a slab, having a thickness of not less than 200 mm.

The improvement of this invention resides in that the curved strand is straightened at a plurality of points at regions of the strand where the thickness of the solidified shell is not more than 60 mm. The obtained strand can be directly supplied to rolling without the necessity of removing the defects from the strand or without reheating the strand.

11 Claims, 7 Drawing Figures

PROCESS FOR BOW TYPE CONTINUOUS CASTING

BACKGROUND OF THE INVENTION

1. Technical Field

The present invention relates to a continuous casting process and, more particularly, to an improvement in straightening a steel strand in a bow type continuous casting process. The present invention is also related to a bow type continuous casting machine for carrying out this process.

2. Description of Prior Art

Recently, the continuous casting technique, in which molten metal is continuously cast to obtain a strand, has been developed and has replaced the ingot making process followed by rough rolling in the metal industry, including the steel industry. The proportion of steel sections produced by the continuous casting process, in which the steel sections are directly obtained from molten steel by continuously casting such steel, is increasing considerably. The continuous casting process is superior to the conventional ingot making-rough rolling process in that it makes possible high production yield of slabs, blooms and the like and low energy consumption for producing the slabs and the like. This is the reason why the proportion of continuously cast steel sections produced as compared with the ingots is increasing Grades of steels to which the continuous casting process can be applied, have become remarkably varied in recent years.

In the continuous casting process, a hot strand with a liquid core is bent from a vertical direction to a curved shape, and then straightened horizontally. Alternatively, a hot strand with a liquid core is straightened from a bow shape to a horizontal line. After the straightening, the strand is cut to a desired length. However, strain tends to occur in the strand during the bending or the straightening and this results in the formation of defects. The horizontal section of the strand after straightening is not completely solidified and thus includes the liquid core in the modern high speed casting, and, therefore, the generation of (a) bulging strain of the strand caused by the ferrostatic pressure of molten metal (hereinafter referred to as the bulging strain) and (b) strain of the strand caused by straightening at the straightening stage (hereinafter referred to as the straightening strain) results in a very complicated problem which is explained in detail hereinbelow.

Advantageously, the continuously cast and cut strand sections having a great sensible heat are supplied to the rolling stage while the strand sections still retain their great sensible heat, with the result that heat energy and the cost of obtaining rollings can be lessened, as compared with a process in which the strand sections are first heated and then rolled. However, strain is generated in the continuously cast strand due to complicated reasons, and this, in turn causes the generation of cracks on the outer surface and in the interior of the strand in the continuous casting process. Therefore, according to the conventional industrial method, the hot steel sections must be cooled down to room temperature and subjected to the removal of defects prior to being supplied to the rolling stage. In order to make it possible to directly supply the hot steel sections obtained by continuous casting to the rolling stage, the steel sections must obviously be free from internal cracks and must be free from the surface defects, i.e. must not need to be subjected to the removal of surface defects and the like.

the kinds of internal and external defects and the reasons why these defects occur are explained in detail hereinafter. In a widely used continuous casting process, a curved mold for casting the longitudinally curved strand is used so as to keep the height of the continuous casting machine low and thus keep the installation cost low. The height of a continuous casting machine is the vertical distance from the top surface of the mold to a horizontal guiding region for the strand. During the straightening of the longitudinally curved strand, i.e. applying to such strand a bending opposite to the curve of the strand, internal cracks, traversal surface cracks, edge cracks and the like may be generated due to the bulging strain and/or the straightening strain.

One of the conventional technical means to prevent the internal cracks, traversal surface cracks, edge cracks and the like is to arrange the supporting and guiding rollers of the strand, which has left the mold, so that the distances between these rollers is small, thereby causing the bulging amount and strain to be lower. Another technical means is intensive cooling at a secondary cooling zone after the molding takes place which seeks to enhance the hot strength of the solidified shell by, for example, spraying water on the steel at a rate of 1.0 l/kg. Another technical means seeks to keep the straightening strain of a curved strand to a low level and is the straightening method for an unsolidified strand having a liquid core, in which method the straightening strain ranging from 0.1 to 0.25% is distributed over a long straightening region of the strand which is thus made horizontal after undergoing straightening at a plurality of straightening points. This method is hereinafter referred to as the multi-point straightening method. Incidentally, most of the modern continuous casting machines for producing a 200–300 mm thick slab are operated under the following parameters.

Radius of curvature of the basic arc: 10–13 m (a large radius of curvature).

Casting speed: 0.7–2.0 m/minute

Supporting and guiding rollers: the distance between these rollers is small.

Secondary cooling: intensive spray cooling by water.

When the above multi-point straightening method is carried out in these continuous casting machines under the limitation that the machine height (10–13 m) is not increased, the starting point of the multi-point straightening is positioned at a distance from the meniscus in the mold of 15.7–20.4 m as measured along the strand. This distance is determined due to the fact that the machine height of from 10 to 13 m is large. The strand surface temperature and the thickness of the solidified shell at this starting point are from 700 to 900° C. and about 80 to 120 mm (estimated value), respectively. When the strand has a cross section 250 mm thick and 1800 mm wide, the total thickness of the solidified parts of the shell in the thickness direction of the strand amounts to from 70 to 90% of the strand thickness. The strand that is straightened, while the solidified shell has such a thickness, exhibits edge crack defects (in percentage) ranging from 10 to 30% and an evaluation point of the internal cracks (the rate of generating C:1.5) ranging from 4 to 5%, even if the strand is straightened by a straightening means utilizing devices for controlling the straightening force and other devices designed at a modern highly technical level. If a strand having the defects as described above is rolled at the temperature required for rolling, a satisfactorily high yield cannot be obtained.

STAHL UND EISEN VOL 95 (1975), No. 16, p 733–741 describes a process of casting, by means of a curved mold, a strand (average thickness 150 mm) having a radius of curvature of 3.9 m at casting speeds of 0.9 m/min and 0.4 m/min, secondarily cooling the strand by spraying water on it and straightening points. The height of the continuous casting machine is 4.0–4.2 m. The process of STAHL UND EISEN does not seek to provide a strand appropriate for direct rolling; however, the present inventors considered this process in the course of attempting to devise a continuous casting process capable of satisfying the requirements for subsequent use of direct rolling. As a result, the inventors consider that it is difficult in the Stahl und Eisen process to reduce the surface defects to a point so low that the strand can be directly supplied to the rolling stage. This is because the solidified shell at the starting point of the straightening is very thick and, because of this thickness, the allowable limit of straightening strain is low according to the analysis, by the present inventors, of the casing parameters.

SUMMARY OF THE INVENTION

It is an object of the present invention to provide a bow type continuous casting process which is highly efficient and which prevents the formation of traversal surface defects, edge crack and other defects, and, hence, supplies a strand to the rolling stage while the strand still retains a great sensible heat.

It is another object of the present invention to provide a bow type continuous casting machine which has a low height and a high efficiency and yet allows production of a strand capable of being directly supplied to the rolling stage.

The strand produced by the process and machine described above should have a good quality in a normal meaning. That is, the strand should be free from center segregation, internal cracks, surface defects and non metallic inclusions. The specific qualities of the strand required for achieving the objects of the present invention are: the surface quality of strand must be so excellent that the strand can be rolled without the removal of surface defects; and the strand must have a high temperature after straightening and cutting, preferably within the temperature range for the starting of the rolling. Due to the low number of defects, the strand can be rolled without removing the suface defects, while due to the high temperature no reheating is necessary for rolling.

In accordance with the objects of the present invention, there is provided a bow type continuous casting process using a curved mold, wherein a molten steel is continuously cast into the curved mold to obtain a curved strand having a thickness of not less than 200 mm and the curved strand is subjected to multi-point straightening, characterized in that the straightening is initiated at a region of the strand where the thickness of the solidified shell is not more than 60 mm and is completed at a region of the strand where the thickness of the solidified shell is not more than 60 mm. In accordance with this process, the region of the strand where the thickness of the solidified shell (the thickness of the solidified shell at each of the inner and outer sides of the curved strand) is thin, is subjected to the straightening, and the allowable straightening strain in this strand section is twice or more that of the conventional process, with the result that the strand can be produced with a very low number of surface defects. Since the allowable straightening strain in the process of the present invention is higher than that of the conventional process, surface defects are not caused, even though the strand undergoes more strain during the straightening process than a strand straightened by the conventional process. In addition, even a curved strand having a small radius of curvature can be deflected to a horizontal line by a straightening method in which the number of straightening points (from three to five) corresponds to that in the conventional method, and such straightening does not result in the formation of surface cracks. As a result, a good surface quality, from the view point of surface defects, and a short straightening zone are simultaneously achieved in the present invention; that is, continuous casting with a low bulging strain can be achieved in a bow type continuous casting machine having a low height.

A bow type continuous casting machine according to the present invention comprises:

a curved mold;

a means for supporting and guiding a curved strand withdrawn from the curved mold;

a means for straightening the curved strand at at least two points of the strand;

a secondary cooling means for spraying a mixed medium of gas and liquid on the curved strand within the region of the supporting and guiding means, and the machine having a height of not more than 4.9 m, particularly not more than 3.5 m. The straightening means may be pinch rollers which are arranged in the straightening zones and which define a curve having a plurality of centers of curvatures. The bow type continuous casting machine may further comprise rollers in a horizontal roller zone where small diameter rollers are provided with a small distance therebetween. The strand straightened in the straightening zone is then guided into the horizontal roller zone and conveyed in this zone over an optional length. In the bow type continuous casting machine of the present invention, the solidified shell of a region of the strand within the straightening roll zone, can be made thin due to (a) the low machine height and (b) slow cooling and/or high speed casting.

DESCRIPTION OF THE PREFERRED EMBODIMENTS

Figure 1:
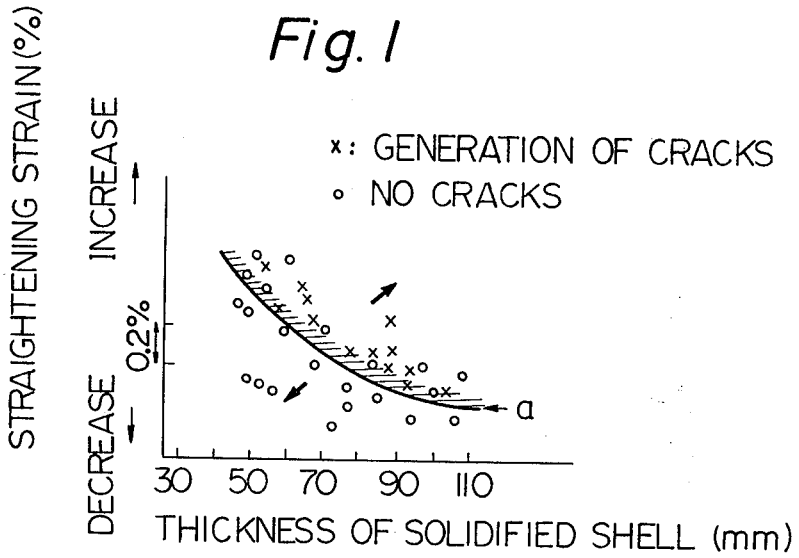
FIG. 1 is a graph of the straightening strain versus the thickness of the solidified shell.

The theoretical aspect of the present invention described hereinafter should be construed as not limiting the present invention. The present inventors conducted experimental research on a bow type machine for continuous casting a molten steel to determine continuous casting conditions that cause no traversal surface cracks, internal cracks or edge cracks of the straightened strand. As a result of the experimental research, the present inventors discovered a continuous casting condition for decreasing the sum of the bulging strain ($\epsilon_\beta$) and the straightening strain ($\epsilon_U$) to a level lower than the critical strain for generating the cracks ($\epsilon_c$).

One of the continuous casting conditions is the temperature of the strand. When the strand is subjected to any deformation including straightening, the strand is liable to crack at a temperature where the critical strain for generating the cracks ($\epsilon_c$) becomes low. This temperature is referred to as a brittleness temperature. This temperature of commonly used steels is from 700 to 900° C. It is therefore important for preventing the cracks to carry out any deformation of the strand at a temperature outside the range of the brittleness temperature. The steel strand is desirably subjected to the deformation or straightening at a temperature exceeding 900° C. The higher the temperature of the region of the strand at which the straightening is carried out, the thinner and lower strength is the solidified shell. The straightening of a region of the strand having a high temperature and thin solidified shell may result in the formation of cracks, because the solidified shell is seriously affected by the bulging strain. From the above statements, it will be understood that the straightening strain and bulging strain have a combined effect on the strand being deformed or straightened. In addition, at a straightening temperature higher than 900° C., the tendency of the crack formation due to the bulging strain becomes conspicuous. Accordingly, the formation of cracks during the straightening can be prevented only by harmonizing both the requirements which are contradictory to one another; that is, keeping the straightening temperature sufficiently high to avoid the brittleness temperature and simultaneously keeping the bulging strain sufficiently low so as not to cause the crack formation in the thin solidified shell. The conditions of continuous casting discovered by the present inventors for the purpose of satisfying the contradictory requirements are: using a curved mold causing a lower ferrostatic pressure and bulging strain ($\epsilon_\beta$) than that caused by the straight mold, and; completing the straightening at a strand region having a thickness of the solidified shell of 60 mm or less for a strand having a thickness of at least 200 mm, particularly from 200 to 300 mm, thereby carrying out the straightening outside the brittleness temperature range. A small distance between the curved mold and the starting point of the straightening is preferable for carrying out the straightening outside the brittleness temperature range. A continuous casting machine, in which the distance between the curved mold and the horizontal region of the strand is small, is referred to as a low head continuous casting machine. The low head continuous casting machine of the present invention should have a small radius of curvature, preferably from approximately 3 to 5 m and should be operated under a high speed casting and/or a slow cooling condition.

Figure 2:
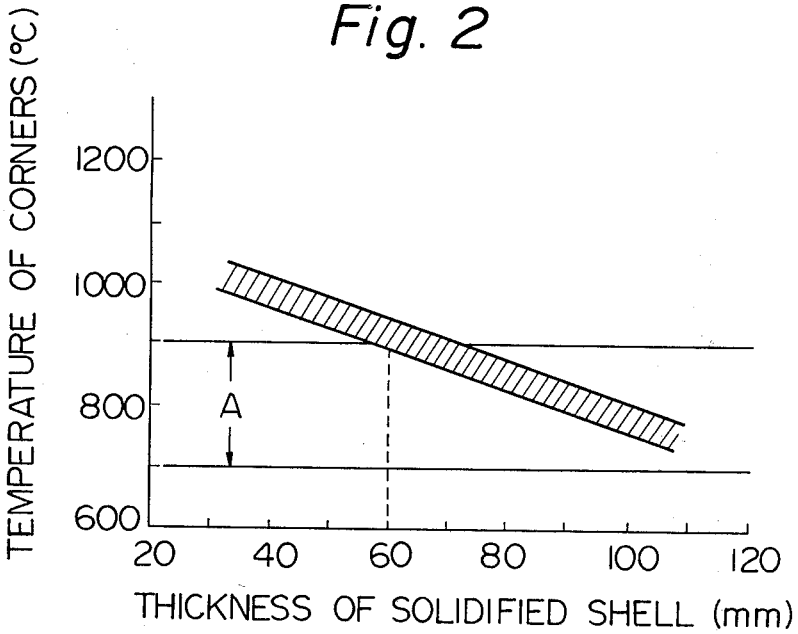
FIG. 2 is a graph of the temperature of the corners of strand versus the thickness of the solidified shell.

Referring to FIG. 1, the relationship between the straightening strain, the thickness of the solidified shell and the generation of cracks is illustrated. The straightening strain in FIG. 1 indicates the strain generated on the solidification interface of the inner side of a curved strand, but only the straightening strain; that is, the bulging strain is not included in the value shown in the ordinate of FIG. 1. Experimental data obtained by the present inventors from casting and straightening 250 mm thick steel slabs by using the low head continuous casting machine are shown in FIG. 1. As is apparent from FIG. 1, when the thickness of the solidified shell is 60 mm or less, the straightening strain can be increased over 0.2% which is the conventional straightening strain in the prior art. When the thickness of the solidified shell is less than 20 mm, the danger of break-out becomes high. The minimum thickness of the solidified shell is preferably 20 mm. When the straightening is carried out at a solidified shell thickness of from 20 to 60 mm, the straightening strain, which does not result in the formation of cracks, can be approximately twice that of the conventional process. This not only allows the problem of cracks caused by the straightening to be effectively solved, but also has a technical significance, as illustrated in FIG. 2. As apparent from FIG. 2, when the solidified shell has a thickness of 60 mm or less, the temperature of the corners of a strand is higher than 900° C. and is outside the brittleness temperature range A. The temperature of a strand is most likely to drop at the corners of the strand; however, the temperature of the corners of the strand can be kept higher than 900° C., preferably 1000° C. or higher, while the strand is straightened by controlling the solidified shell thickness so that it is 60 mm or less.

Another technical significance of the thin solidified shell, i.e. the solidified shell having a thickness of 60 mm or less, is that the relaxation of the stress induced in the strand as a result of the deformation occurs from ten to one hundred times more quickly because of the high temperature of the strand, as compared with the conventional process. This contributes to suppression of the formation of cracks as explained hereinafter. In order to keep the bulging strain to a low level, it is necessary to keep the height of the bow type continuous casting machine small as explained hereinbelow. This can be attained by making the radius of curvature of the curved mold small, which, in turn leads to a reduction of the radius of curvature of the strand. If such a strand is straightened at, for example, one point, the straightening strain may be increased to a level above the critical strain for generating the cracks ($\epsilon_c$). The multi-point straightening used for straightening the strand having a small radius of curvature allows distribution of the straightening strain over the straightening zone in such a manner that the straightening strain at each straightening point does not exceed the critical strain for generating cracks. In such multi-point straightening, a thin (60 mm or less) shell and high temperature (900° C. or higher) allow the relaxation of stress at a high speed. This means that the stress can be relieved in the time interval during which the strand travels through the short spaces between the respective straightening points, even when the casting speed is high. An accumulation of stress, which causes the generation of cracks, thus does not take place.

Another technical significance of the thin solidified shell is explained hereinafter. When the curved strand is straightened, the inner side (concave face) and outer side (convex face) of the curve strand are subjected to a tensional force and a compression force, respectively, which forces act in the longitudinal direction along the curved strand. The distribution of the forces in the thickness direction of the strand is such that the neutral axis which divides the strand into the concave section under the tensional force and the convex section under the compression force, extends longitudinally along the strand, and the magnitude of these forces is proportional to the distance in the strand thickness direction from this neutral axis to a given point of the strand subjected to one of these forces. The tensional force mentioned above is one of the causes that generate the surface and internal cracks when the curved strand is straightened. The straightening of a curved strand according to the present invention, in which the thickness of the solidified shell in the region of the curved strand being straightened is controlled to be 60 mm or less, is constrained by the solidified shell to a low extent as compared with the conventional process, with the result that the position of the neutral axis is not the center between the concave and convex faces, as in the conventional process, but is shifted from this center toward the concave face. The tensional force, which is proportional to the distance from the neutral axis as stated above, is reduced in the present invention as compared with the conventional process, and thus the tensional force is not likely to cause cracks.

The significance of the solidified shell thickness will be understood from the theoretical aspect of the present invention explained above.

As to the operation condition for attaining the thickness of the solidified shell at the straightening points by using a low head continuous casting machine, it is necessary to rely on at least either the high speed casting or withdrawal of the strand and slow secondary cooling. Both the high speed casting and the slow secondary cooling are preferably employed for producing the strand, thereby ensuring a high productivity of high temperature strands without defects. The withdrawal (casting) speed should be not less than 1.2 m/minute, particularly from 1.5 to 3 m/minute. The cooling of the strand prior to the straightening should be carried out by a mixture of a gas and a liquid. By this mixture it is possible to extensively adjust the degree of cooling from a slow cooling to an intensive cooling. The proportion of gas and liquid in the mixture in terms of the flow rate, in a case of casting at a speed of 1.2 m/min or more, particularly from 1.5 to 3 m/min, should be such that the air flow rate is from 25 to 50 $Nm^3$/hour, and the water flow rate is from 0.2 to 15 l/minute. The water flow rate and the air flow rate may be as high as 30 l/minute and 50 $Nm^3$/hour, respectively, so as to intensively cool the strand.

It is explained hereinafter how to determine the number of straightening points in the multi-point bending method of the present invention. The height of the bow type continuous casting machine must be so low that the thickness of the solidified shell should not be more than 60 mm at the starting and completing points of the straightening, and further the bulging strain should be limited to 0.4% or less. The radius of curvature of the curved mold and the number of straightening points should be mutually dependent and must be such that the low height of the machine and the straightening strain induced by multi-point straightening does not exceed the strain for generating the cracks ($\epsilon_c$) are achieved. The distance between the rollers should be such that the rapid relaxation of stress is fully utilized due to the thin shell and high temperature. The number of straightening points is determined from the above consideration. However, the number of straightening points is preferably as many as possible, because the reaction force from the strand on the straightening rollers can be distributed over a number of the straightening rollers and thus mitigated. Such reaction force is applied to the straightening rolls when the low temperature top part of the strand formed at the end of the casting travels through these rolls or when the bottom part of the strand travels through these rolls during the non-stationary casting period. The number of the straightening points is desirably kept as small as possible so that only a small amount of labor is necessary to adjust and maintain the roller alignment in the straightening roller zone of the bow type continuous casting machine.

It is very advisable in carrying out the process of the present invention, in view of such a low height of the bow type continuous casting machine, to suppress the bulging strain so that: the radius of curvature of the curved mold is from 2 to 4.9 m and, thus, is small; and the straightening of the cast strand is carried out in a multi-point straightening zone of the machine, wherein the number of the straightening points is at the least two and at the most fifteen.

The curved mold should have a radius of curvature of at least 2 m, because this is the minimum radius for ensuring a smooth pouring of the molten steel into the mold by means of an immersion nozzle and also for a high speed casting.

The process of the present invention is particularly suitable for the production of slabs. The curved mold having a substantially rectangular cross section is therefore used for the casting. When the curved mold has a small radius of curvature, the normally rectangular cross section of the strand can be more easily obtained after straightening by using a mold having a trapezoidal cross section (the top smaller side and bottom larger size of the trapezoid are directed to the outer and inner side of the strand curve, respectively) as compared with using a mold having the normally rectangular cross section. The curved mold therefore includes that having a trapezoidal cross section.

The bulging amount ($\delta_\beta$) and bulging strain ($\epsilon_\beta$) are expressed by the following equations (1) and (2), respectively:

$$\delta_\beta = \frac{\alpha \cdot k \cdot p \cdot l^4 \cdot \sqrt{\frac{l}{v}}}{d^3} \text{ (mm)} \quad (1)$$

$$\epsilon_\beta = \frac{1600 \cdot \delta_\beta \cdot d}{l^2} \text{ (\%)}, \quad (2)$$

wherein $\alpha$ is a shape factor of the strand and is 0.15 in the case of a slab;

$\kappa = 1.02/1500\text{-}T$;

T is the temperature of a given region of the strand in °C.;

P is the ferrostatic pressure of the molten metal in $kg/mm^2$;

d is the thickness of the solidified shell in mm;

l is the distance between the rollers in mm; and;

V is a casting speed in mm/min.

The low head continuous casting machine used in accordance with the present invention allows the ferrostatic pressure to be maintained at a low level.

Figure 3:
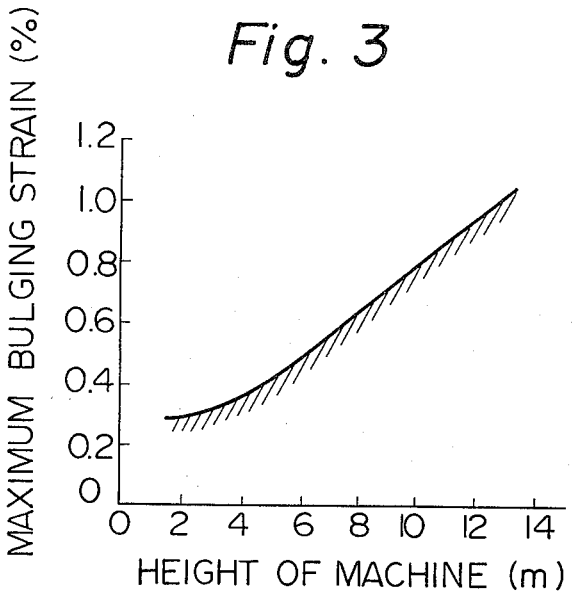
FIG. 3 is a graph of the height of a continuous casting machine versus the maximum bulging strain.

FIG. 3 illustrates research results obtained by the present inventors and the estimated maximum bulging strain of modern representative continuous casting machines and this strain was calculated by the present inventors under the assumption that: a high speed and slow cooling casting is carried out in these machines; and, a strand has a thickness of the solidified shell of 60 mm or less and a surface temperature of 900° C. or more at the inlet from the curved zone to the horizontal of these machines.

As is well known, internal cracks due to bulging can be will suppressed by keeping the bulging strain to 0.4% or less over the region at least from directly below the curved mold to the solidification completion point, preferably over the entire bow type continuous casting machine. In addition, when the bulging strain is reduced from 0.4% toward 0%, the center segregation can be more effectively suppressed in accordance with the reduction of the bulging strain.

It will be apparent from FIG. 3 that the maximum bulging strain ($\epsilon_\beta$) of 0.4% or less will be attained by carrying out a high speed and slow cooling casting of a strand in a bow type continuous casting machine having a height of 4.9 m or less. This means that, in the high speed and slow cooling casting intended to ensure a thin solidified shell in the straightening zone or horizontal zone of the bow type continuous casting machine and also a high surface temperature of the strand, i.e. 900° C. or higher, preferably 1000° C. or higher, internal cracks due to the bulging strain can be will suppressed. A height of the bow type continuous casting machine of 3.5 m or lower contributes to a suppression of internal cracks and the center segregation, because the bulging strain is almost zero %.

The diameter ($D_R$) of the rollers is expressed by:

$$D_R \propto f(p\ L) \quad (3),$$

when the bulging amount ($\delta_\beta$) and bulging strain ($\epsilon_\beta$) are expressed by the equations (1) and (2), respectively. L is the length of the roller body. Incidentally, for example, both slow cooling and high speed casting (withdrawal), make it possible for the strand to leave the continuous casting machine at high temperature, according to the process of the present invention. The slow cooling causes the reduction of K in the equation (1), while the high speed casting (withdrawal) causes the reduction of $\sqrt{(l/v)}$ in the equation (1). Since both K and $\sqrt{(l/v)}$ are reduced, the bulging amount ($\delta_\beta$) and bulging strain ($\epsilon_\beta$) are decreased by multiple amounts. An example of a bow type continuous casting machine capable of carrying out the casting at the maximum bulging strain of 0.4% or less has a height of 4.9 m or less and a curved mold for forming 250 mm thick and 2100 mm wide slab, is provided with rollers, the main ones at the curved zone having a diameter of from 140 to 300 mm and the distances therebetween being from 190 to 300 mm and the main ones in the horizontal zone having a diameter of from 250 to 300 mm and being at distances of from 300 to 800 mm, particularly from 450 to 800 mm, and is operated at a high casting speed and with slow cooling. The casting speed can be 1.5 m/min. The cooling conditions can be such that the portion of the strand adjoining the curved region of the strand has a thickness of the solidified shell of 60 mm or less and a surface temperature of 900° C. or more. It is to be noted that the maximum distance between the rollers of the horizontal zone may be as high as 800 mm and the minimum diameter of the rollers may be as small as 300 mm. With these conditions, the high temperature of a strand which leaves the bow type continuous casting machine can be ensured.

The bow type continuous casting machine known from STAHL UND EISEN Vol 95 (1975), NO. 16, p 733–741 is a machine for producing small width slabs having an average dimension of 150 mm in thickness and 600 mm in width and which machine has a height of from 4.0 to 4.2 m. In this machine, the main rollers arranged in the horizontal zone of the bow type continuous casting machine have a diameter of 380 mm and are arranged so that the distance between the rollers is 430 mm. These rollers are considered in the field of continuous casting to be of a large diameter and to be closely arranged rollers. These rollers are disadvantageous because of high installation cost, and because the cost and number of the rollers is high.

The bow type continuous casting process according to the present invention achieves the casting of thick and wide slabs, for example, having a thickness of 250 mm and width of 2100 mm. The bulging of such thick and wide slabs can be satisfactorily prevented, even when a high temperature operation is carried out. This is accomplished by the fact that the height of the continuous casting machine is 4.9 m or less and further the rollers arranged in the curved zone for carrying out the multi-point straightening have a small diameter and each of the rollers consists of separate roller members. An example of the casting parameters which make it possible to cast the thick and wide slabs, is: the distance between the main rollers arranged in a horizontal zone of the bow type continuous casting machine is 800 mm or less; the diameter of these rollers is 350 mm or less; and, the casting speed is from 1.6 to 1.8 m/min. In addition to the casting of the thick and wide slabs, a high temperature of slabs at the end of the bow type continuous casting machine, e.g. 1100° C. or higher, is achieved by these parameters, the quality of center segregation is remarkably enhanced, and the percentage of slabs from which the defects must be removed is considerably reduced as compared with the conventional process.

Figure 4:
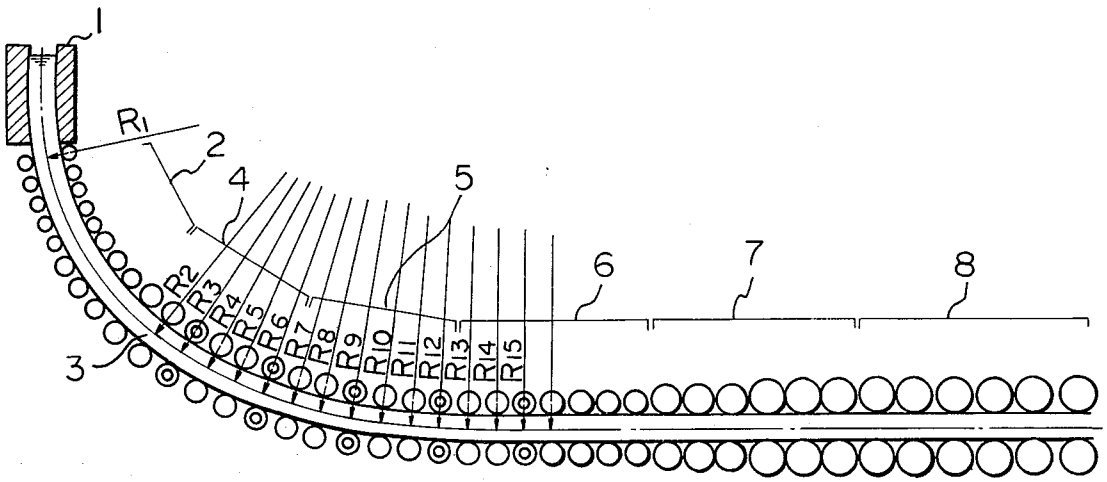
FIG. 4 is a schematic drawing illustrating the essential parts of a bow type continuous casting machine according to the present invention.

Referring to FIG. 4, the essential parts of the bow type continuous casting machine according to the present invention are schematically illustrated. In FIG. 4, the reference numeral 1 denotes a curved mold, and a strand 3 provided with a radius of the curvature ($R_1$) ranging from 2 to 4.9 m is withdrawn from the curved mold 1, guided and supported by the roller apron 2 which consists of eight pairs of driven or non driven rollers. This roller apron 2 is followed by five zones. The first zone is the first straightening means 4 consisting of six pairs of rollers. At the first roller pair of this first straightening means 4, the straightening from the curve having the radius of curvature ($R_1$) toward the horizontal line is started and the thickness of the solidified shell of the region of the strand where the straightening is started is 60 mm or less. In the first straightening means 4, straightening is carried out five times and changes the radius of curvature from $R_1$ to $R_2$, $R_3$, $R_4$, $R_5$ and $R_6$, respectively. Similarly, the second straightening means 5 constituting the second zone and the third straightening means 6 constituting the third zone straighten the strand and the curves having the radii of curvature from $R_7$ to $R_{15}$ are formed by the strand being straightened. The straightening is completed at $R_{15}=\infty$. In the process of the present invention, the thickness of the solidified shell must be 60 mm or less over the entire region of a strand where the radius of curvature of strand ($R_i$) is increased from the value less than that of the mold to the maximum finite value. The thickness of the solidified shell of the horizontal region of strand in the fourth and fifth zone, which are the straightening and withdrawal units 7 and 8, respectively, is not specifically limited. In the straightening and withdrawal units 7 and 8, the strand is withdrawn and guided to a cutting station (not shown) during which time the strand is neither reheated nor intentionally held at the same temperature.

The temperature of the cut strand leaving the bow type continuous casting machine can be as high as the rolling temperature according to the present invention. The diameter of rollers along the strand, the distances between the rollers, the straightening times and the other casting parmeters shown in FIG. 4 should be construed to be illustrative of the present invention but not limiting it at all.

Figure 5A:
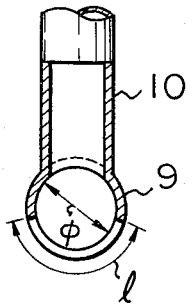
FIGS. 5A, 5B and 6 illustrate an embodiment of the secondary cooling means for spraying the gas-and-liquid-mixed medium, with FIGS. 5A and 5B being a partial cross sectional view and a side view of a spray nozzle, respectively, and FIG. 6 being a partial view of a continuous casting machine.
Figure 5B:
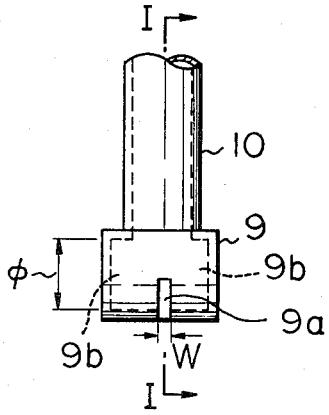
Figure 6:
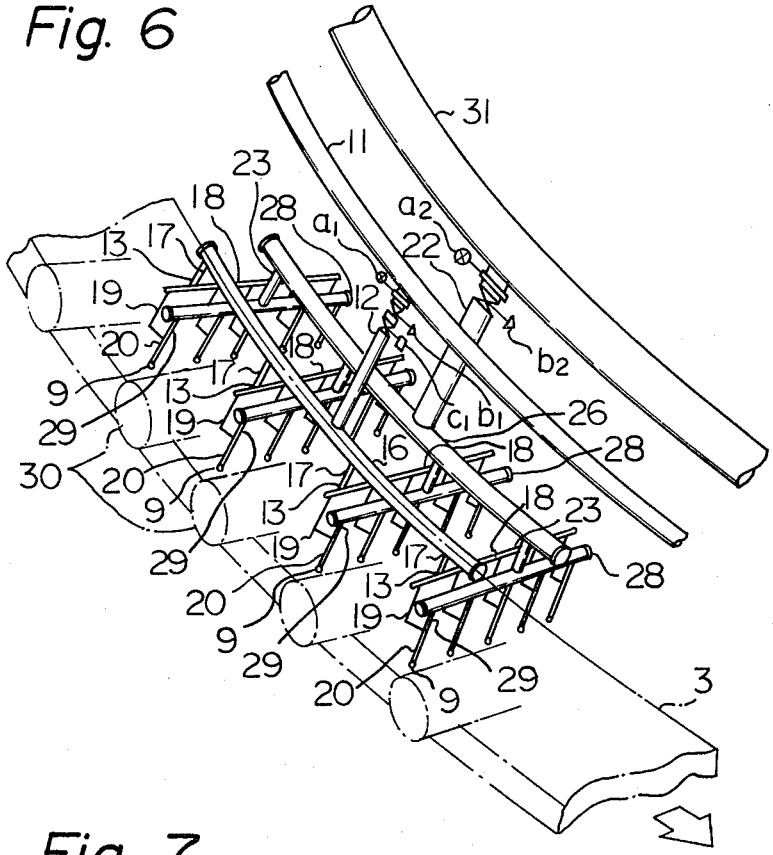

Referring to FIGS. 5A, 5B and 6, an example of nozzles for spraying the air and liquid mixture is illustrated. These nozzles are used in the roller apron 2 (FIG. 4) and in the straightening zones defined by the first, second and third straightening means 4, 5 and 6, respectively. The nozzles 9 for spraying the air and gas, which are hereinafter simply referred to as the spraying nozzles 9, have an outlet 9*a* which is defined in the tubular wall thereof by slit with the width W and length l. The width W may be from 2 to 3 mm, and the length l may be from 10 to 30 mm. The tubular portion of the spraying nozzles 9 defines therein a pressurizing space 9*b* having a diameter $\phi$ which may be from 12 to 14 mm. The outlet 9*a* is formed by dividing the front surface of tubular wall into two halves. The spraying nozzles 9 are disposed above and below the region of the strand to secondarily cool the strand by the air and water mixture. A plurality of the spraying nozzles 9, i.e. five spraying nozzles 9 in FIG. 6, are arranged in the direction parallel to the axis of the rollers 30, and these spraying nozzles 9 apply the air and water mixture onto the strand regions exposed between the rollers 30. Conduit means for separately supplying the air and water to each of the spraying nozzles 9 are provided above and below the strand 3, but only the supplying conduits above the strand are shown in FIG. 6. One of the cooling regions, that is, the region of strand to be subjected to the secondary cooling by means of one common supplying system, is shown in FIG. 6. The reference numerals 11 and 31 denote the main conduits for cooling water and air, respectively. The supplying conduits for supplying the cooling water from the main conduit 11 to each of the spraying nozzles 9 comprises a controlling main conduit 12 for the cooling water, and this controlling main conduit 12 is fitted with a flow meter $a_1$, a control valve $b_1$ and a stop valve $c_1$. A branch conduit 13 connected to an intermediate header 16 through a throttle tube 17 is connected to the controlling main conduit 12. A final header 18 and a terminal tube 19 are successively connected to the branch conduit 13, and the terminal tube 19 is also connected to the water and gas mixing tube 10. On the other hand, the supplying conduits for the compressed air from the main conduit 31 to each of the spraying nozzles 9 comprises a controlling main conduit 22 fitted with a flow meter $a_2$ for the compressed air and a control valve $b_2$ for the compressed air. An intermediate header 26, a branch conduit 23, a final header 28 and the terminal tube 29 are successively connected to the controlling main conduit 22. The terminal tube 29 is integrally connected to the water and gas mixing tube 10. Each of the spraying nozzles 9 is connected to the front end of the water and gas mixing tube 10.

The spraying nozzles illustrated in FIGS. 5A, 5B and 6 are illustrated in a Japanese Patent Application filed by Nippon Steel Corporation; however the aim of this application is to obtain the thickness of the solidified shell specified herein.

Figure 7:
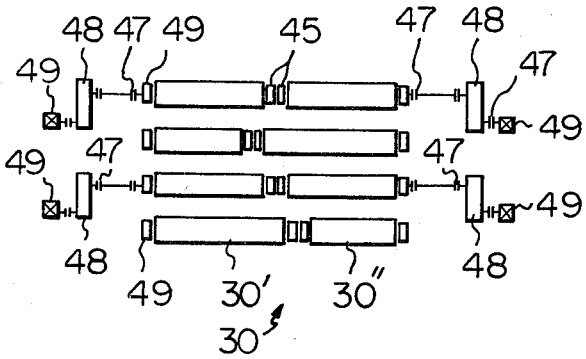
FIG. 7 illustrates the separate members of a roller.

Referring to FIG. 7, an embodiment of the present invention is shown, wherein one or more rollers of the straightening means consist of at least two separate roller members spaced in the width direction of the strand. Due to the use of such separate roller members, the diameter of the rollers can be decreased and thus the rollers can be arranged close to each other (40-50 mm) in the longitudinal direction of the strand. Because of the close arrangement of the rollers, it is easier to deal with a hot strand with a thin solidified shell and a low rigidity, and particularly to absorb the reaction force when straightening the first and last regions of a strand. The rollers 30 each consist of two roller members 30' and 30'' having a respective central bearing 45. The roller members 30' and 30'' may be driven as shown in FIG. 6, by means of the motors 49 which are operably connected to the roller members 30' and 30'' through a coupling 47 and a reduction gear 48. The central bearings 45 and bearings 49, which are connected to the driven end of the roller members, are secured to a machine frame or traversal beam (not shown). The separate roller members are disclosed in Japanese Laid Open Patent Application 10124/1976; however the aim of this application is to use these rollers for a guiding device for the strand.

As has been known in the art of the continuous casting, the supporting and guiding means and the straightening means must occasionally be disassembled from the continuous casting machine and be replaced with the new ones, when the dimension of the strand is changed. The use of several pairs of separate roller members is advantageous for disassembling these rollers in unison and facilitates handling the change of the strand dimension.

The present invention will be further explained by way of the Examples.

EXAMPLE 1

A strand having a thickness of 250 mm and a width of 1000 mm was cast in a bow type continuous casting machine having a height of 3.2 m. The first curve of the strand was defined by the curved mold and its radius of curvature was 3 m. The casting parameters for producing the strand were as follows.

Casting speed: V=1.7 m/minute

The spraying rate of water: 0.8 l/kg

The thickness of the solidified shell at the straightening points of the curved strand was:

$$d \leqq 43 \text{ mm}$$

For the purpose of comparison, the casting parameters were adjusted as follows.

The casting speed: V=0.7 m/min~0.5 m/min

The spraying rate of water: 1.8 l/kg

The thickness of the solidified shell at the straightening points of the curved strand was: d=70 mm~90 mm.

The percentages of the defects of the strand were as follows.

| | Surface Defects | Internal Cracks |
|---|---|---|
| Present invention | 0.5% | 0% |
| Comparison example | 20% | 30% |

EXAMPLE 2

A strand having a thickness of 250 mm and a width of 1000 mm was cast by a bow type continuous casting machine (FIG. 4) having a height of 3 m. The first curve of the strand was defined by the curved mold and its radius of curvature was 3.2 m. The casting parameters for producing the strand were as follows.

Casting speed: V=1.7 m/minute

The spraying rate of water: 0.8 l/kg

The thickness of the solidified shell at the straightening points of the curved strand was: d<43 mm.

The diameters of the main rollers arranged in a horizontal part of the bow type continuous casting machine were 300–320 mm, and the distances between these rollers were 500–600 mm.

We claim:

1. A bow type continuous casting process using a curved mold, comprising:
   - continuously casting molten steel into the curved mold to obtain a curved strand having a thickness of not less than 200 mm;
   - subjecting the curved strand to multi-point straightening, initiating the straightening at a region of the strand where the thickness of the solidified shell of the strand is at least 20 mm and not more than 60 mm; and
   - controlling the speed of the strand and the cooling conditions while carrying out the multi-point straightening for maintaining the thickness of the solidified shell from at least 20 mm to not more than 60 mm until completion of said straightening.

2. A process as claimed in claim 1 in which the casting into the curved mold is in the vertical direction and the end of the straightening step is horizontal, and the vertical dimension between the casting into the mold and the end of the straightening step is less than 4.9 m, and the speed of movement of the strand is not less than 1.2 m/min.

3. A process as claimed in claim 2 in which said vertical dimension is less than 3.5 m and the speed of movement of the strand is from 1.5 to 3 m/min.

4. A process as claimed in claim 1 further comprising maintaining the bulging strain of the strand at no more than 0.4% along at least the portion of the strand being straightened by said multi-point straightening.

5. A process as claimed in claim 4 comprising maintaining said bulging strain along the entire length of the strand from the outlet of the mold to the completion of the straightening.

6. A process as claimed in claim 2 further comprising maintaining the bulging strain of the strand at no more than 0.4% along at least the portion of the strand being straightened by said multi-point straightening.

7. A process as claimed in claim 1 in which the curved mold has a substantially rectangular horizontal cross-section.

8. A process as claimed in claim 3 further comprising cutting of the straightened strand before the temperature thereof drops below 900° C.

9. A process as claimed in claim 3 further comprising cutting of the straightened strand before the temperature thereof drops below 1000° C.

10. A process as claimed in claim 1 in which the number of straightening points is not more than fifteen.

11. A process as claimed in claim 2 in which the number of straightening points is not more than fifteen.

* * * * *